US005430910A

United States Patent [19]

Wiley

[11] Patent Number: 5,430,910

[45] Date of Patent: Jul. 11, 1995

[54] CARPET CLEANING APPARATUS

[76] Inventor: Jeff Wiley, 2764 E. Miraloma Ave., Anaheim, Calif. 92806

[21] Appl. No.: 173,089

[22] Filed: Dec. 27, 1993

[51] Int. Cl.[6] ..... A47L 7/00

[52] U.S. Cl. ..... 15/321; 15/353; 55/244

[58] Field of Search ..... 15/321, 353, 352; 55/244–246

[56] References Cited

U.S. PATENT DOCUMENTS

| | | | |
|---|---|---|---|
| 2,606,624 | 8/1952 | Chiotte . | |
| 3,341,081 | 9/1967 | King . | |
| 3,619,848 | 10/1969 | Salzmann . | |
| 3,624,668 | 11/1971 | Krause . | |
| 3,774,260 | 11/1973 | Emus | 15/353 X |
| 4,088,462 | 5/1978 | Laule et al. | 15/353 X |
| 4,107,816 | 8/1978 | Matthews . | |
| 4,109,340 | 8/1978 | Bates . | |
| 4,121,915 | 10/1978 | Anderson | 55/244 X |
| 4,153,968 | 5/1979 | Perkins | 15/321 |
| 4,154,578 | 5/1979 | Bane . | |
| 4,158,248 | 6/1979 | Palmer . | |
| 4,182,001 | 1/1980 | Krause . | |
| 4,191,590 | 3/1980 | Sundheim . | |
| 4,207,649 | 6/1980 | Bates . | |
| 4,244,079 | 1/1981 | Bane | 15/321 |
| 4,267,618 | 5/1981 | Cuscovitch . | |
| 4,284,127 | 8/1981 | Collier et al. . | |
| 4,330,084 | 5/1982 | Buchner et al. . | |
| 4,333,204 | 6/1982 | Bascus . | |
| 4,339,840 | 7/1982 | Monson . | |
| 4,377,018 | 3/1983 | Cain . | |
| 4,475,264 | 10/1984 | Schulz . | |
| 4,821,367 | 4/1989 | McAllister et al. | 15/353 |
| 5,334,000 | 8/1994 | Nordin | 15/353 X |

*Primary Examiner*—Christopher K. Moore
*Attorney, Agent, or Firm*—Gary Appel

[57] ABSTRACT

A water/cleaning solution vacuum carpet cleaning apparatus includes a carpet cleaning wand having a carpet contacting end region, a source of pressurized water and a source of pressurized carpet cleaning solution. Piping and controls are included for selectively providing pressurized water and cleaning solution to the carpet contacting end region of the wand. Included is a dirty liquid-air separation vessel having an outer shell, an air tube coaxially installed in the shell and a dirty liquid tube installed in the shell and extending around portions of air discharge tube in a spaced apart relationship so as to form a first, inner annular space therebetween. A second, outer annular space is defined between the shell and the dirty liquid tube, a lower end of which is spaced above the bottom of the shell. A dirty liquid and air suction pipe extends through the shell and into upper regions of the inner annular space. A dirty liquid discharge conduit is connected through the shell and into the second annular space above the lower end of the shell so that accumulated dirty liquid in the bottom of the vessel seals off lower regions of the dirty liquid tube, thereby reducing its volume and increasing efficiency of the apparatus. A flexible fluid conduit is connected between the wand and an inlet end of the air and dirty liquid tube at the separation vessel, vacuum applied to the air tube causing suctioning of the air and dirty liquid from the wand into the vessel for separation therein. Upper regions of the first and second annular spaces are interconnected and a regulator controls the pressure differential between the two annular spaces.

25 Claims, 4 Drawing Sheets

CARPET CLEANING APPARATUS

BACKGROUND OF THE INVENTION

1. Field of the Invention

The present invention relates generally to the field of carpet cleaning apparatus and more particularly to water/cleaning solution vacuum carpet cleaning apparatus, principally of the large, commercial or industrial type, and still more particularly to waste water and cleaning solution-air separation vessels used in such carpet cleaning apparatus.

2. Background Discussion

Although most homeowners and apartment dwellers are familiar with small, hand carried carpet cleaning apparatus of the type commonly rented at supermarkets and hardware stores, they are unfamiliar with large commercial or industrial carpet cleaners. Such large, commercial or industrial carpet cleaning apparatus, which employ high pressure water and carpet cleaning solutions, are commonly used to clean large expanses of carpets, for example, in office buildings, and common areas of hotels and conference centers where carpets are subject to a large amount of heavy foot traffic and which are subject to spilled food and drinks.

These large commercial or industrial types of carpet cleaners are typically built into trucks or towable trailers which permit carpets to be cleaned on site. Various United States patents disclose different aspects of large commercial or industrial types of carpet cleaning apparatus. For example, U.S. Pat. Nos. 4,443,909 to J.D. Cameron; 4,475,264 to R. R. Schultz; 3,341,081 to W. L. King; 4,158,248 to M. C. Palmer; 4,109,340 to L. E. Bates; 4,154,578 and 4,244,079 to W. F. Bane; 4,191,590 to J. J. Sundheim; 4,207,649 to J. A. Bates; 4,267,618 to J. F. Cuscovitch; 4,264,826 to W. UIImann; and 4,284,127 to S. W. Collier et al disclose large, commercial-type mobile carpet cleaning apparatus which are vehicle mounted. In contrast, U.S. Pat. No. 4,182,001 to H. W. Krause discloses a smaller carpet cleaning apparatus that is non-vehicle mounted but which is still larger than the typical light duty carpet cleaners commonly rented in stores.

All of such disclosed carpet cleaning apparatus have various advantages as well as certain disadvantages. So far as is known to the present inventor, all such carpet cleaning apparatus are relatively inefficient because of the type of waste water and cleaning solution-air separation tanks or vessels used. Such separation tanks are connected to the implement—typically an elongate, hand operated cleaning wand—used for contacting a carpet being cleaned. Below ambient pressure applied to the separation tank suctions dirty, used water or a mixture of dirty water and cleaning solution along with air from the cleaning wand into the separation tank wherein the dirty liquid is separated from the air and is pumped, for example, to a holding tank associated with the carpet cleaning apparatus or to a suitable drain connection where the carpets are being cleaned.

Because such waste liquid-air separation tanks have heretofore, to Applicant's knowledge, been constructed with relatively large separation regions, considerable power has been required to provide the necessary vacuum pressure to quickly and effectively remove dirty waste liquid from the carper being cleaned. This large amount of power required to provide a vacuum increases the size of the equipment needed and/or decreases the cleaning efficiency—that is, the carpet cleaning rate of the quality of the cleaning operation.

For this and other reasons, the present Applicant has invented an improved carpet cleaning apparatus employing a highly efficient air-dirty waste liquid separation tank.

SUMMARY OF THE INVENTION

In accordance with the present invention, a water/-cleaning solution vacuum carpet cleaning apparatus comprises a carpet cleaning wand having a handle end region and an opposite, carpet contacting end region; a source of pressurized water; a source of pressurized carpet cleaning solution and means connected for selectively providing pressurized water from the pressurized water source and pressurized cleaning solution from the pressurized carpet cleaning solution source to the carpet contacting end region of the wand. Included in the carpet cleaning apparatus of the present invention is a dirty water and cleaning solution-air separation vessel, which itself comprises a shell, an air tube installed in said shell, said air tube having an air inlet at an upper end and having an outlet end extending outwardly through said shell; a dirty water and cleaning solution tube installed in the shell and extending around portions of the air discharge tube in a spaced apart relationship so as to form an annular space therebetween, a lower end of the dirty water and cleaning solution tube being spaced upwardly from the bottom of the shell; an air and dirty water and cleaning solution suction pipe extending through the shell and into upper regions of the annular space between the air tube and the dirty water and cleaning solution tube; and a dirty water and cleaning solution discharge conduit connected through the shell above the lower end of the dirty water and cleaning solution tube so that dirty water and cleaning solution suctioned from the carpet contacting region of the wand by suction applies to the air tube inlet and accumulating at the bottom of the separation vessel seals off the lower end of the dirty water and cleaning solution tube and reduces the suction volume in the vessel.

The carpet cleaning apparatus further comprises a flexible fluid conduit connected between the wand and an inlet end of the air and dirty water and cleaning solution tube, and a suction source connected to the outlet end of the air tube for suctioning air and dirty water and cleaning solution from the wand, through the flexible fluid conduit and suction pipe and into the separation vessel for separation therein and for suctioning air from the separation vessel through the air tube.

Included is a pump for pumping dirty water and cleaning solution through the dirty water and cleaning solution discharge conduit from the separation vessel for discharge from the apparatus.

The source of pressurized water preferably includes a clean water tank and a clean water pump connected to an outlet of said clean water tank, and the source of pressurized cleaning solution preferably includes a cleaning solution tank and a cleaning solution pump connected to an outlet of said cleaning solution tank.

In accordance with a preferred embodiment of the present invention, the source of pressurized cleaning solution includes a feedback fluid conduit connected between a location downstream of the cleaning solution pump and lower regions of the cleaning solution tank, Pressurized cleaning solution flowing through the feedback conduit into the cleaning solution tank causes turbulent mixing of the cleaning solution contained in the cleaning solution tank so as to keep the cleaning solution thoroughly mixed.

Preferably, the suction source comprises an air blower, and a waste pump is provided for pumping dirty water and cleaning solution through the dirty water and cleaning solution discharge conduit from the separation vessel. A power source, preferably an internal combustion engine, is provided for rotatably driving the waste water and cleaning solution pump, the clean water pump, the cleaning solution pump and the air blower.

There is correspondingly provided for a water-cleaning solution carpet cleaning apparatus, a dirty water and cleaning solution-air separation vessel which comprises a vessel shell; an air discharge tube installed in the shell and having an air inlet at an upper end and having an outlet end extending outwardly through the shell, the outlet end of the air discharge tube being configured for connection to a vacuum source operative for applying a vacuum to the air discharge tube; a dirty water and cleaning solution tube installed in the shell inwardly therefrom and extending around portions of the air discharge tube in a spaced apart relationship so as to form a first, inner annular space between the dirty water and cleaning solution tube and the air discharge tube and a second, outer annular space between the dirty water and cleaning solution tube and the shell. A lower end of the dirty water and cleaning solution tube is spaced upwardly from the bottom of said shell. An air and dirty water and cleaning solution suction pipe extends through the shell and into upper regions of the first annular space between the air tube and the dirty water and cleaning solution tube, the suction tube being configured for connection to a carpet cleaning wand so as to receive dirty water and cleaning solution therefrom.

Further included is a dirty water and cleaning solution discharge conduit connected through the shell and having an inlet above the lower end of the dirty water and cleaning solution tube, an outlet end of the conduit being outside of the shell and being configured for connection to a waste liquid pump operative for pumping dirty water and cleaning solution from the vessel to a discharge point.

Preferably, a one-way flow valve and regulator are connected between the second, outer annular space and the first, inner annular space for controlling the relative pressures in the two annular spaces.

In accordance with a preferred embodiment of the invention, the vessel shell is cylindrical in shape and is configured for having a longitudinal axis thereof in a vertical orientation. In such case, the air tube and the dirty water and cleaning solution tube are coaxially disposed along the longitudinal axis of the shell. Included is an air filter disposed around the air tube at an upper end thereof for filtering air entering the tube from the annular region between the dirty water and cleaning solution tube and the air tube.

Preferably, the vessel is cylindrical in shape and the air tube and the dirty water and cleaning solution tube are coaxially disposed relative to the vertical axis of the shell.

The separation vessel adds significantly to the efficiency of the carpet cleaning system by reducing the volume of the suction system, thereby improving the suctioning of waste water and cleaning solution, through the wand, from a carpet being cleaned by the apparatus.

BRIEF DESCRIPTION OF THE DRAWINGS

The present invention can be more readily understood by a consideration of the following detailed description when taken in conjunction with the accompanying drawings, in which.

In the various FIGS. identical elements and features are given the same reference number.

DETAILED DESCRIPTION OF THE INVENTION

Figure 1:
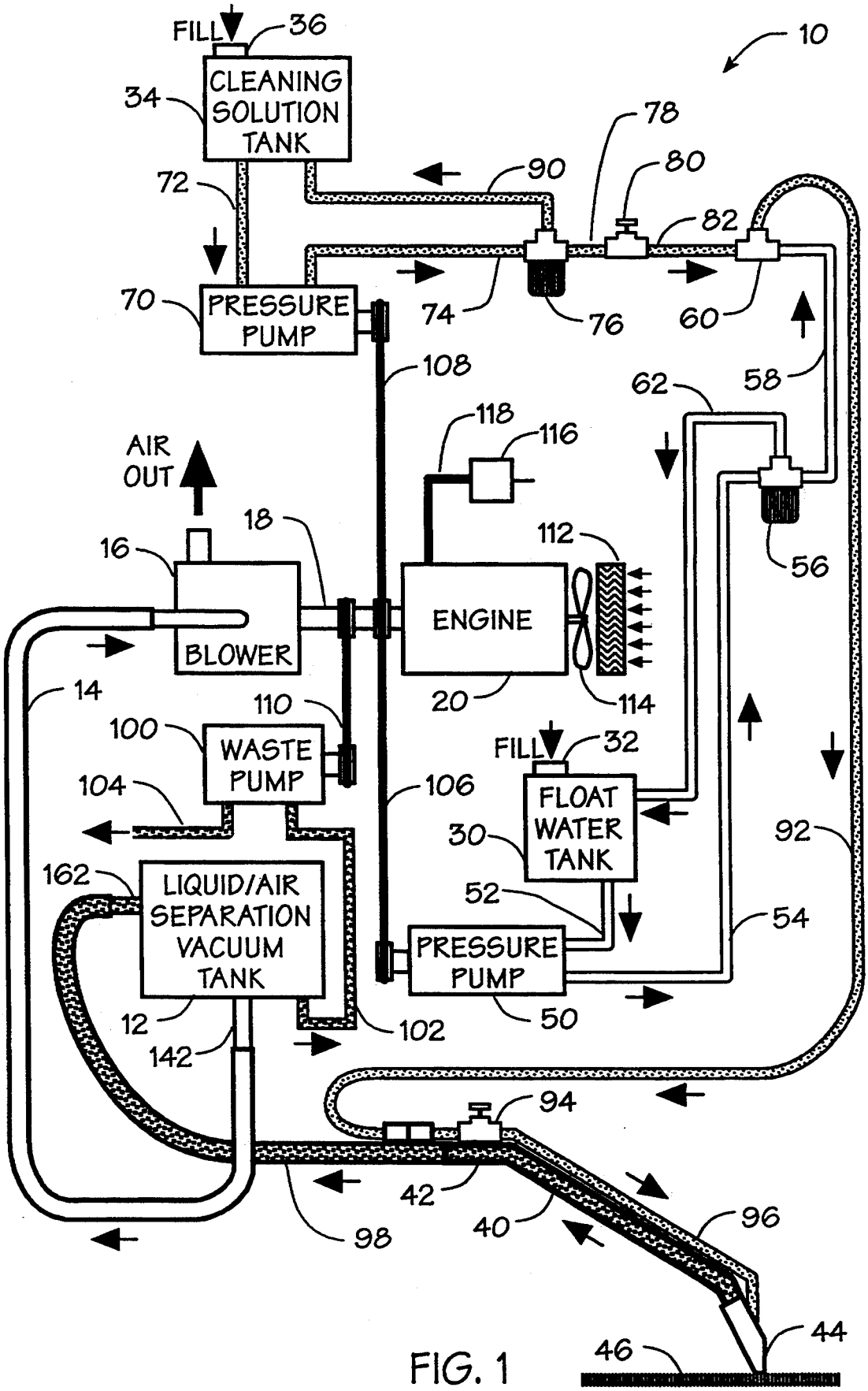
FIG. 1 is a schematic drawing in general block diagram form depicting a commercial type of water/detergent vacuum carpet cleaning apparatus in accordance with the present invention and showing the various functional components thereof, including an improved dirty water and cleaning solution-air separation vessel according to the present invention.

These is shown in FIG. 1, a water and cleaning solution vacuum carpet cleaning apparatus 10 in accordance with the present invention. Comprising apparatus 10, as more particularly described below, is a waste or dirty water and cleaning solution-air separation vessel or tank 12 to which a vacuum is applied, through a conduit 14, by a blower 16 which is driven, thorough a shaft 18, by a power source 20 which is depicted, by way of example, as an internal combustion engine.

Otherwise, generally comprising carpet cleaning apparatus 10 are a clean water float tank 30 having a filler 32, and a cleaning solution slurry tank 34 having a filler 36. A hand-operated cleaning wand 40 is included as part of apparatus 10, the cleaning wand having a handle end region 42 and a carpet contacting or cleaning end region or nozzle 44 which is adapted for being pushed and/or pulled along the surface of a carpet 46 to be cleaned by the apparatus.

Clean water from water float tank 30 is fed to a clean water pressure pump 50 through a water pipe or conduit 52. Clean water is pumped by pump 50 at high pressure, through a high pressure conduit 54, to a pressure regulator and relief valve 56 which maintains the water pressure at a selected level, for example, at about 500 psi. High pressure water from water pressure regulator and relief valve 56 is flowed through a small diameter, high pressure conduit 58 to a mixing tee or valve 60. In the event of an over pressure from pump 50, water is returned from pressure regulator and relief valve 56 to water float tank 30 through a pressure relief conduit 62.

Cleaning solution, which may be a mixture of detergent and water, from cleaning solution tank 34 is flowed to a cleaning solution pressure pump 70 through a conduit 72. From cleaning solution pump 70, high pressure cleaning solution is pumped through a small diameter pressure conduit 74 to a pressure regulator and relief valve 76, which is similar to above-mentioned water pressure regulator and relief valve 56.

From pressure regulator and relief valve 76, high pressure cleaning solution is fed, through a conduit 78 to a metering valve 80 and thence, through a conduit 82, to mixing valve 60. Cleaning solution is fed back to its tank 34 from pressure regulator and relief valve 76, through a conduit 90, and enters the tank in a location causing turbulent mixing of the solution in the tank so as to keep any detergent solids in suspension.

From mixing tee or valve 60 high pressure clean water from tank 30 or a high pressure mixture of clean water and cleaning solution from cleaning solution tank 34 is flowed through a small diameter fluid conduit 92 to handle portion 42 of wand 40. Installed in conduit 92 is a control valve 94 which enables an operator to control the flow of water or water and cleaning solution to wand 40. Contained within or as part of wand 40 is a high pressure fluid conduit which directs water or a mixture of water and cleaning solution to rug contacting or nozzle region 44 of the wand.

Air and waste or used, dirty water or a mixture of dirty water and cleaning solution is suctioned into separation vessel 12 from wand 40 through a suction conduit 98. In turn, the waste liquid is discharged from separation vessel 12 by a waste liquid pump 100 which is connected to the vessel by a fluid conduit 102. From waste pump 100, dirty water or a mixture of dirty water and cleaning solution is pumped through a fluid conduit 104 to a discharge point, for example, a preexisting commercial drain or sewer line.

Clean water pump 50, cleaning solution pump 70 and waste liquid pump 100 are driven by respective drive belts 106, 108 and 110 from engine drive shaft 18 in a conventional manner. Shown associated with engine 20 is a cooling radiator 112 and an engine-mounted fan 114. Conventional engine controls 116 are connected to engine 20 through an appropriate conduit or control lines 118.

SEPARATION VESSEL 12

Figure 2:
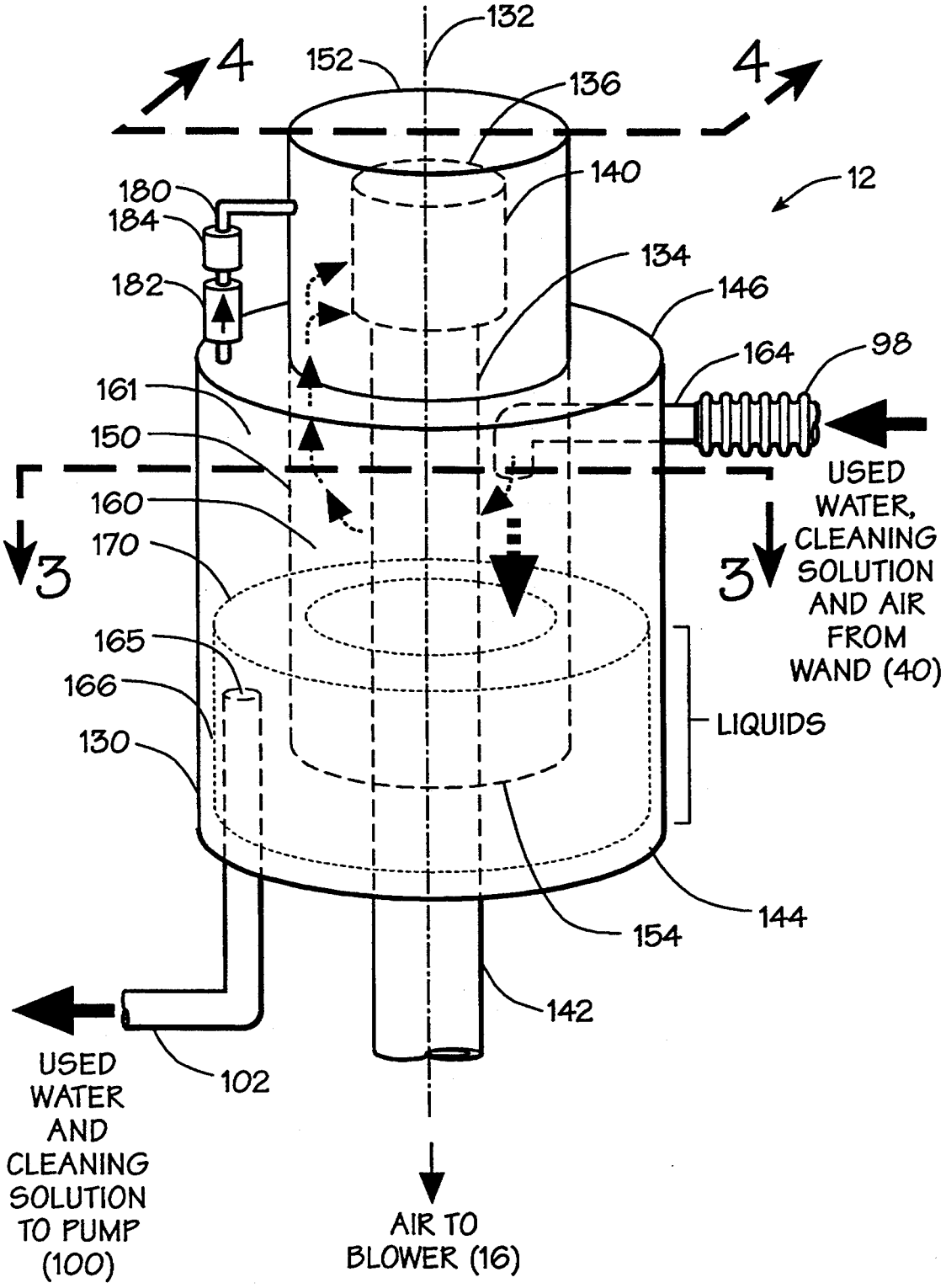
FIG. 2 is a partial perspective drawing of the dirty water and cleaning solution-air separation vessel of FIG. 1 showing the internal construction thereof.
Figure 3:
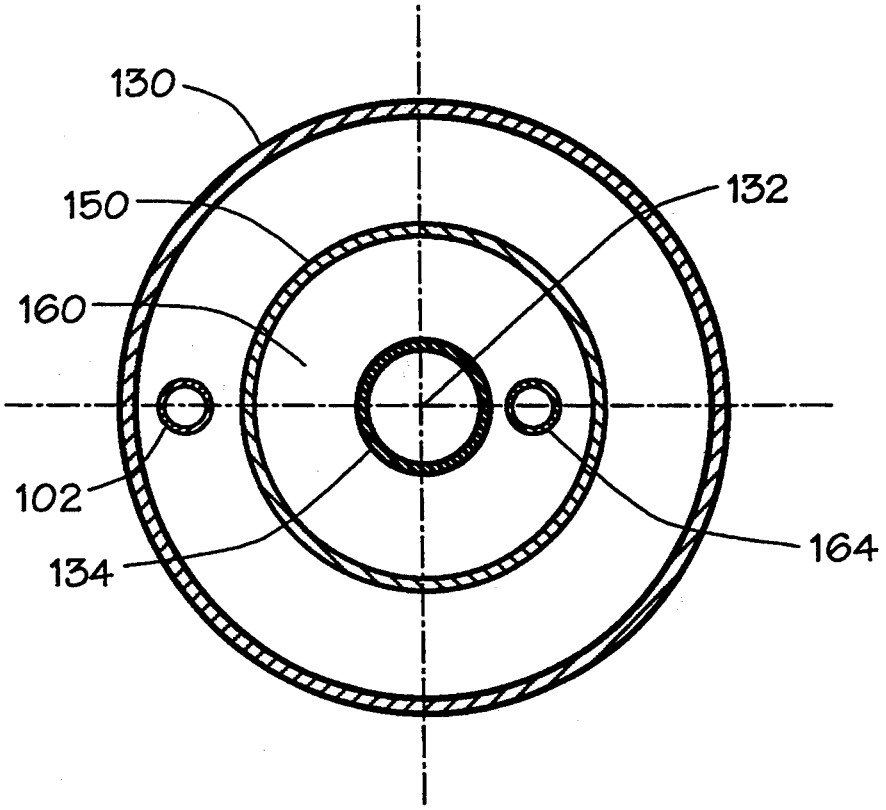
FIG. 3 is a transverse cross sectional drawing taken along line 3—3 of FIG. 2 further showing the internal construction of the dirty water and cleaning solution-air separation vessel.
Figure 4:
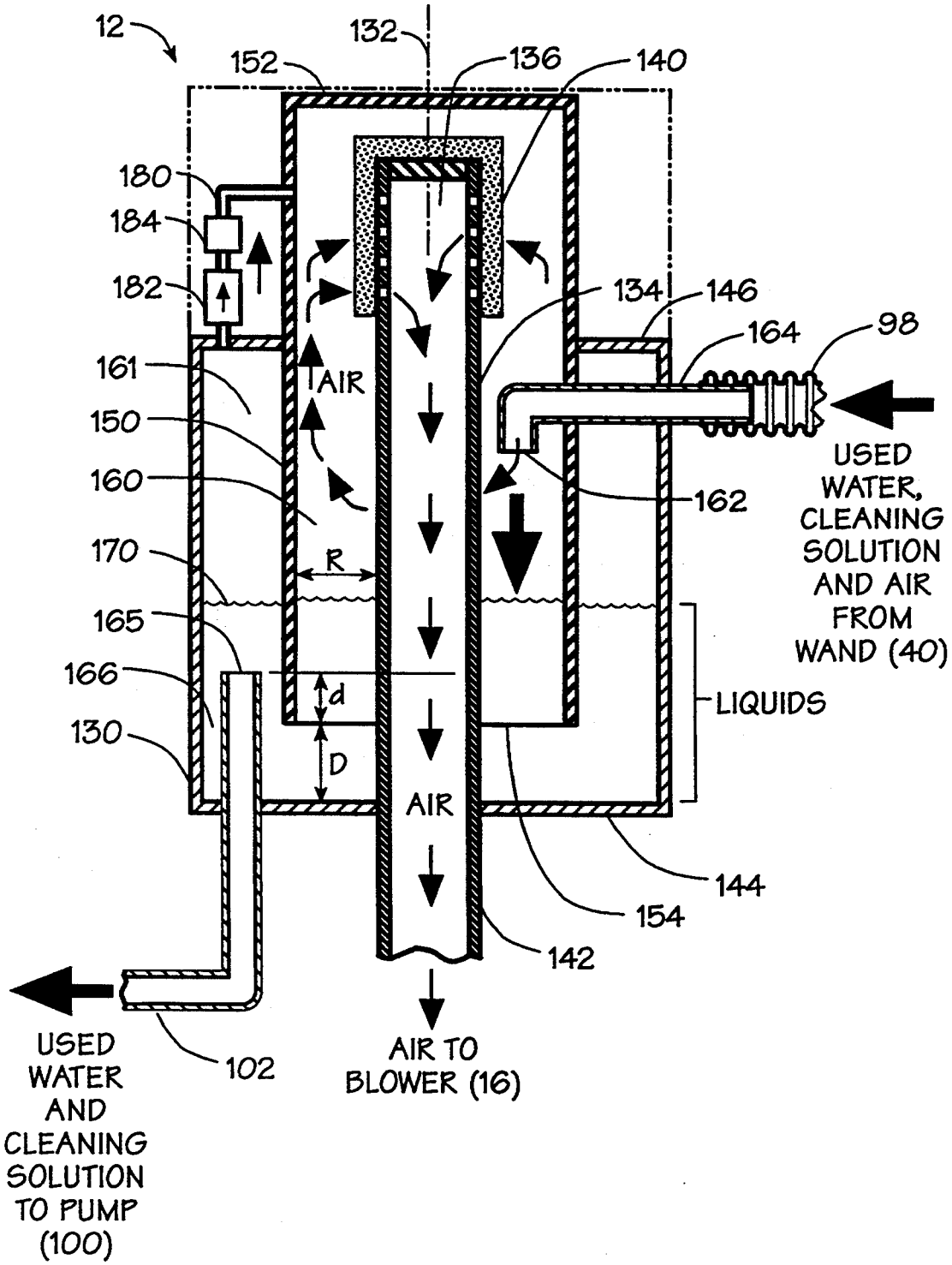
FIG. 4 is a longitudinal cross sectional drawing taken along line 4—4 of FIG. 2 showing other internal features of the dirty water and cleaning solution-air separation vessel.

As shown in FIGS. 2 through 4, separation vessel 12 comprises a metal outer shell 130 which is preferably cylindrical in shape with a vertically-oriented longitudinal axis 132. Disposed in shell 130, coaxially with axis 132, is a cylindrical air tube 134 having side walls that are closed except for a perforated air inlet region 136 at the upper end of the tube. Surrounding air inlet region 136 is an air filter 140. Air tube 134 has an air outlet end region 142 which extends axially outwardly from vessel shell 130 through a bottom 144 thereof. As shown in FIGS. 2 and 4, upper end region 136 of air tube extend upwardly from a top 146 of vessel shell 130.

Installed coaxially around upper regions of air tube 134, including the perforated upper end region 136, is another tube 150 which may be called a dirty water and cleaning solution tube. Tube 150 has a closed top 152 and an open bottom region 154 which is spaced a distance, D, which may be several inches, above shell bottom 142 (FIG. 4). Dirty water and cleaning solution tube 150 is spaced radially outwardly from air tube 134 a distance, R, which may be several inches, so as to form a first, inner annular air-liquid separation space 160 between the two tubes. Although tube 150 is shown as extending upwardly through shell top 146 to the upper end of air tube 134, shell 130 may alternatively be constructed such that its top extends to the top of tubes 134 and 150 (as indicated in phantom lines in FIG.4). Dirty water and cleaning solution tube 150 is spaced inwardly from vessel shell 130 and a second, outer annular space 161 is formed between the tube and the shell.

A discharge end 162 of an air and dirty water and cleaning solution conduit 164 extends through shell 130 and dirty water and cleaning solution tube 150 into upper regions of first, inner annular space 160 so as to discharge into such space air and dirty water or air and a mixture of dirty water and cleaning solution received from suction conduit 98 which, as above described is connected to wand 40 as shown in FIG. 1.

Waste liquid conduit 102 which, as shown in FIG. 4, extends upwardly through shell bottom 144 and into second, outer annular space 161, has a waste liquid inlet end 165 located a distance, d, which may be several inches, above open bottom of waste water and cleaning solution tube 150. Consequently, waste water or a mixture of waste water and cleaning solution always remains in a region 166 below inlet end 165, thereby sealing off open bottom 154 of tube 150. This restricts the suction region of vessel to the comparatively small volume annular space 160 above the level of inlet end 165 of waste liquid conduit 102, thereby substantially improving suction power of apparatus 10.

As previously described, waste conduit 102 is connected to waste liquid pump 100 (FIG. 1) which pumps waste liquid from vessel 12. Discharge region 142 of air tube 134 is connected to conduit 14 (FIG. 1) which is, in turn, connected to blower 16. Operation of blower 16 is such as to create a suction vacuum in conduit 14 and hence in air tube 134. This vacuum in turn suctions air and waste liquid into vessel 12 from wand 40 through air and waste water conduit 164 and conduit 98. as air and waste liquid is discharged from outlet end 162 of air and waste liquid conduit 164, air is suctioned upwardly through annular space 160, through filter 140 and into air tube 134 through its perforated upper end region 136. Waste liquid (that is, dirty water or a mixture of dirty water and cleaning solution) discharged from outlet end 162 of conduit 164 falls under gravity toward vessel bottom 144, water level 170 always being above open bottom 154 of air and waste liquid tube 150.

There is shown in FIGS. 2 and 4, a conduit 180 that is connected, through shell top 146 and dirty water and cleaning solution tube 150, between upper regions of second, outer annular space 161 and first, inner annular space 160. Included in conduit 180 is a one-way (i.e., check) valve 182 and pressure regulator 184. One-way valve 182 limits air flow from second, outer annular space 161 to first, inner annular space 160 and regulator 184 controls the difference in air pressure between the two mentioned annular spaces.

Although there has been described and illustrated an improved water/cleaning solution vacuum carpet cleaning apparatus, and in particular a dirty water and cleaning solution-air separation vessel used therewith, in accordance with the present invention for purposes of illustrating the manner in which the invention may be used to advantage, it is to be appreciated that the invention is not limited thereto. Therefore, any and all variations and modifications that may occur to those skilled in the art are to be considered as being within the scope and spirit of the claims as appended hereto.

What is claimed is:

1. A water/cleaning solution vacuum carpet cleaning apparatus which comprises:

a. a carpet cleaning wand having a handle end region and an opposite, carpet contacting end region;

b. a source of pressurized water;

c. a source of pressurized carpet cleaning solution;

d. means connected for selectively providing pressurized water from said pressurized water source and pressurized cleaning solution from said pressurized carpet cleaning solution source to said carpet contacting end region of said wand;

e. a dirty water and cleaning solution-air separation vessel comprising;

(1) a shell;

(2) an air tube installed in said shell, said air tube having an air inlet at an upper end and having an outlet end extending outwardly through said shell;

(3) a dirty water and cleaning solution tube installed in said shell and extending around portions of said air discharge tube in a spaced apart relationship so as to form a first, inner annular space between the dirty water and cleaning solution tube and the air discharge tube and a second, outer annular space between the dirty water and cleaning solution tube and the shell, a lower end of said dirty water and cleaning solution tube being spaced upwardly from the bottom of said shell;

(4) an air and dirty water and cleaning solution suction pipe extending through said shell and into upper regions of said first, inner annular space; and (5) a dirty water and cleaning solution discharge conduit connected through said shell and into said second, outer annular space above the lower end of said dirty water and cleaning solution tube;

f. a flexible fluid conduit connected between said wand and an inlet end of said air and dirty water and cleaning solution tube; and g. a suction source connected to the outlet end of said air tube for suctioning air and dirty water and cleaning solution from said wand, through said flexible fluid conduit and suction pipe and into said separation vessel for separation therein in said first, inner annular space and for suctioning air from the separation vessel trough said air tube.

2. The water/cleaning solution vacuum carpet cleaning apparatus as claimed in claim 1, including a pump for pumping dirty water and cleaning solution through the dirty water and cleaning solution discharge conduit from said second, outer annular space for discharge from the apparatus.

3. The water/cleaning solution vacuum carpet cleaning apparatus as claimed in claim 1, wherein said source of pressurized water includes a clean water tank and a clean water pump connected to an outlet of said clean water tank.

4. The water/cleaning solution vacuum carpet cleaning apparatus as claimed in claim 1, wherein said source of pressurized cleaning solution includes a cleaning solution tank and a cleaning solution pump connected to an outlet of said cleaning solution tank.

5. The water/cleaning solution vacuum carpet cleaning apparatus as claimed in claim 4, wherein the source of pressurized cleaning solution includes a feedback fluid conduit connected between a location downstream of said cleaning solution pump and lower regions of said cleaning solution tank, pressurized cleaning solution flowing through said feedback conduit into said cleaning solution tank causing turbulent mixing of the cleaning solution contained in said cleaning solution tank.

6. The water/cleaning solution vacuum carpet cleaning apparatus as claimed in claim 1, wherein the suction source comprises an engine driven air blower.

7. The water/cleaning solution vacuum carpet cleaning apparatus as claimed in claim 1, including a waste pump for pumping dirty water and cleaning solution through the dirty water and cleaning solution discharge conduit from said separation vessel, wherein said source of pressurized water includes a clean water tank and a clean water pump connected to an outlet from said clean water tank, wherein said source of pressurized cleaning solution includes a cleaning solution tank and a cleaning solution pump connected to an outlet from said cleaning solution tank, and wherein the suction source comprises an air blower.

8. The water/cleaning solution vacuum carpet cleaning apparatus as claimed in claim 7, including a power source connected for rotatably driving said waste pump, said clean water pump, said cleaning solution pump and said air blower.

9. The water/cleaning solution vacuum carpet cleaning apparatus as claimed in claim 8, wherein the power source comprises an internal combustion engine.

10. The water/cleaning solution vacuum carpet cleaning apparatus as claimed in claim 1, including an air conduit connected between upper regions of said second, outer annular space and said first, inner annular space and including a pressure regulator installed in said conduit for selectively regulating the relative air pressure between said second and first annular spaces.

11. The water/cleaning solution vacuum carpet cleaning apparatus as claimed in claim 10, including a one-way flow valve installed in said conduit interconnecting the second and first annular spaces, said one-way valve permitting air to flow only from said second annular space to said first annular space.

12. A water/cleaning solution vacuum carpet cleaning apparatus which comprises:

a. a carpet cleaning wand having a handle end region and an opposite, carpet contacting end region;

b. a source of pressurized water, including a clean water tank and a clean water pump connected to an outlet of said clean water tank;

c. a source of pressurized carpet cleaning solution, including a cleaning solution tank and a cleaning solution pump connected to an outlet of said cleaning solution tank;

d. means connected to said clean water pump and said cleaning solution pump for selectively providing pressurized water from said clean water pump and pressurized cleaning solution from said cleaning solution pump to said carpet contacting end region of said wand;

e. a dirty water and cleaning solution-air separation vessel comprising;

(1) a shell;

(2) an air tube installed in said shell and having an air inlet at an upper end and having an outlet end extending outwardly through said shell;

(3) a dirty water and cleaning solution tube installed in said shell and extending around portions of said air discharge tube in a spaced apart relationship so as to form a first, inner annular space between the dirty water and cleaning solution tube and the air discharge tube and a second, outer annular space between the dirty water and cleaning solution tube and the shell, a lower end of said dirty water and cleaning solution tube being spaced upwardly from the bottom of said shell;

(4) an air and used water and cleaning solution suction pipe extending through said shell and into upper regions of said first, inner annular space; and (5) a used water and cleaning solution discharge conduit connected through said shell and into said second, outer annular space above the lower end of said dirty water and cleaning solution tube;

f. a flexible fluid conduit connected between said wand and an inlet end of said air and dirty water and cleaning solution tube;

g. an air blower connected to the outlet end of said air tube for suctioning air and dirty water and cleaning solution from said wand, through said flexible fluid conduit and suction pipe and into said separation vessel for separation therein and for suctioning air from the separation vessel through said air tube; and h. a waste liquid pump for pumping dirty water and cleaning solution through the dirty water and cleaning solution discharge conduit from said separation vessel for discharge from the apparatus.

13. The water/cleaning solution vacuum carpet cleaning apparatus as claimed in claim 12, wherein the source of pressurized cleaning solution includes a feedback fluid conduit connected between a location downstream of said cleaning solution pump and lower regions of said cleaning solution tank, pressurized cleaning solution flowing through said feedback conduit into said cleaning solution tank causing turbulent mixing of the cleaning solution contained in said cleaning solution tank.

14. The water/cleaning solution vacuum carpet cleaning apparatus as claimed in claim 13, including a power source connected for rotatably driving said waste pump, said clean water pump, said cleaning solution pump and said air blower.

15. The water/cleaning solution vacuum carpet cleaning apparatus as claimed in claim 14, wherein the power source comprises an internal combustion engine.

16. The water/cleaning solution vacuum carpet cleaning apparatus as claimed in claim 12, including an air conduit connected between upper regions of said second, outer annular space and said first, inner annular space and including a pressure regulator installed in said conduit for selectively regulating the relative air pressure between said second and first annular spaces, and further including a one-way flow valve installed in said conduit interconnecting the second and first annular spaces, said one-way valve permitting air to flow only from said second annular space to said first annular space.

17. A dirty water and cleaning solution-air separation vessel for a water-cleaning solution carpet cleaning system, said separation vessel comprising:

a. a vessel shell;

b. an air discharge tube installed in said shell and having an air inlet at an upper end and having an outlet end extending outwardly through said shell, said outlet end of said air discharge tube being configured for connection to a vacuum source operative for applying a vacuum to said air discharge tube;

c. a dirty water and cleaning solution tube installed in said shell and extending around portions of said air discharge tube in a spaced apart relationship so as to form a first, inner annular space between the dirty water and cleaning solution tank and the air discharge tube and a second, outer annular space between the dirty water and cleaning solution tube and the shell, a lower end of said dirty water and cleaning solution tube being spaced upwardly from the bottom of said shell;

d. an air and dirty water and cleaning solution suction pipe extending through said shell and into upper regions of said first, inner annular space, said suction tube being configured for connection to a carpet cleaning wand so as to receive dirty water and cleaning solution therefrom; and e. a dirty water and cleaning solution discharge conduit connected through said shell and into said second, outer annular space, and having an inlet above the lower end of said dirty water and cleaning solution tube, an outlet end of said conduit being outside of said shell and being configured for connection to a waste liquid pump operative for pumping dirty water and cleaning solution from said vessel to a discharge point.

18. The dirty water and cleaning solution-air separation vessel as claimed in claim 17, wherein said vessel shell is cylindrical in shape and is configured for having a longitudinal axis thereof in a vertical orientation.

19. The dirty water and cleaning solution-air separation vessel as claimed in claim 18, wherein the air tube and the dirty water and cleaning solution tube are coaxially disposed along said longitudinal axis of said shell.

20. The dirty water and cleaning solution-air separation vessel as claimed in claim 17, including an air filter disposed around the air tube at an upper end thereof for filtering air entering said tube from the annular region between the dirty water and cleaning solution tube and the air tube.

21. The dirty water and cleaning solution-air separation vessel as claimed in claim 17, including means for interconnecting upper regions of the first, inner annular space and the second, outer annular space and for regulating the pressure differential therebetween.

22. A dirty water and cleaning solution-air separation vessel for a water-cleaning solution carpet cleaning system, said separation vessel comprising:

a. a generally cylindrical vessel shell configured for having a longitudinal axis thereof in a vertical orientation;

b. an air discharge tube installed in said shell coaxially with said shell longitudinal axis and having an air inlet at an upper end and having an outlet end extending outwardly through the bottom of said shell, said outlet end of said air discharge tube being configured for connection to a vacuum source operative for applying a vacuum to said air discharge tube;

c. a dirty water and cleaning solution tube installed in said shell and extending around portions of said air discharge tube in a spaced apart relationship so as to form a first, inner annular space between the dirty water and cleaning solution tube and the air discharge tube and a second, outer annular space between the shell and the dirty water and cleaning solution tube, a lower end of said dirty water and cleaning solution tube being spaced upwardly from the bottom of said shell;

d. an air and dirty water and cleaning solution suction pipe extending through said shell and into upper regions of said first, inner annular space, said suction tube being configured for connection to a carpet cleaning wand so as to receive dirty water and cleaning solution therefrom; and e. a dirty water and cleaning solution discharge conduit connected through said shell and into said second, outer annular space and having an inlet above the lower end of said dirty water and cleaning solution tube, an outlet end of said conduit being outside of said shell and being configured for connection to a waste liquid pump operative for pumping dirty water and cleaning solution from said vessel to a discharge point.

23. The dirty water and cleaning solution-air separation vessel as claimed in claim 22, wherein said vessel shell is cylindrical in shape and is configured for having a longitudinal axis thereof in a vertical orientation.

24. The dirty water and cleaning solution-air separation vessel as claimed in claim 22, including an air filter disposed around the air tube at an upper end thereof for filtering air entering said tube from the annular region between the dirty water and cleaning solution tube and the air tube.

25. The dirty water and cleaning solution-air separation vessel as claimed in claim 22, including an air conduit connected between upper regions of said second, outer annular space and said first, inner annular space and including a pressure regulator installed in said conduit for selectively regulating the relative air pressure between said second and first annular spaces, and further including a one-way flow valve installed in said conduit interconnecting the second and first annular spaces, said one-way valve permitting air to flow only from said second annular space to said first annular space.

* * * * *